United States Patent [19]

Audeh

[11] Patent Number: 4,536,279

[45] Date of Patent: Aug. 20, 1985

[54] ENHANCED RECOVERY OF HYDROCARBONACEOUS FLUIDS FROM OIL SHALE

[75] Inventor: Costandi A. Audeh, Princeton, N.J.

[73] Assignee: Mobil Oil Corporation, New York, N.Y.

[21] Appl. No.: 572,040

[22] Filed: Jan. 19, 1984

[51] Int. Cl.[3] ..... C10G 1/00; C10G 1/04

[52] U.S. Cl. ..... 208/11 R; 208/11 LE

[58] Field of Search ..... 208/8 R, 11 R, 11 LE

[56] References Cited

U.S. PATENT DOCUMENTS

| | | | |
|---|---|---|---|
| 1,706,468 | 3/1929 | Struben | 208/8 R |
| 1,778,515 | 10/1930 | Hampton | 208/8 R |
| 1,868,733 | 7/1932 | Egloff | 208/8 R |
| 1,868,737 | 7/1932 | Egloff | 208/8 R |
| 1,904,477 | 4/1933 | Krauch et al. | 208/8 R |
| 3,228,869 | 1/1966 | Irish | 208/11 R |
| 3,870,621 | 3/1975 | Arnold et al. | 208/11 R |
| 3,887,453 | 6/1975 | Veta et al. | 208/11 R |
| 4,246,093 | 1/1981 | Wolcott, Jr. | 208/11 R X |

*Primary Examiner*—D. E. Gantz
*Assistant Examiner*—Glenn A. Caldarola
*Attorney, Agent, or Firm*—Alexander J. McKillop; Michael G. Gilman; Charles A. Malone

[57] ABSTRACT

The present application relates to a method for enhancing the recovery of hydrocarbonaceous fluids from oil shale containing organic carbon material which comprises heating the oil shale in a retort vessel to a temperature at which thermal decomposition of the organic carbons is initiated. After the initial thermal decomposition temperature is reached, a pre-determined quantity of oil is introduced into the retort wherein the amount of added oil is sufficient to enhance the organic carbon conversion to hydrocarbonaceous fluids and wherein the majority of the added oil does not distill at the initial thermal decomposition temperature of the organic carbons in the shale. Subsequently, the retort temperature is increased to that temperature where the highest amount of organic carbon conversion is obtained. This second higher temperature is maintained for a period of time sufficient to allow substantial conversion of organic carbon material. Subsequently, retorting is continued by increasing the temperature to about 525° C. The present invention results in the recovery of increased amounts of oil as compared to Fischer Assay methods.

21 Claims, No Drawings

ENHANCED RECOVERY OF HYDROCARBONACEOUS FLUIDS FROM OIL SHALE

FIELD OF THE INVENTION

The present invention relates to an improved process for the recovery of hydrocarbonaceous fluids from oil shale. More specifically, the present invention relates to a method which substantially increases the yield of hydrocarbonaceous fluids from oil shale under critical processing conditions.

BACKGROUND OF INVENTION

The potential reserves of liquid hydrocarbons contained in subterranean carbonaceous deposits are known to be very substantial and form a large portion of the known energy reserves in the world. In fact, the potential reserves of liquid hydrocarbons to be derived from oil shale greatly exceed the known reserves of liquid hydrocarbons to be derived from petroleum. As a result of the increasing demand for light hydrocarbon fractions, there is much current interest in economical methods for improving the recovery of hydrocarbon liquids from oil shale on commercial scales.

It has long been known that oil may be extracted by retorting from various extensive deposits of porous minerals known by their generic term "oil shale", which are permeated by a complex organic material called "kerogen". Upon application of retorting, the kerogen is converted to a complex mixture of hydrocarbons and hydrocarbon derivatives which may be recovered from a retort as a liquid shale oil product. While conventional retorting processes may be the most common methods utilized to recover hydrocarbon fluids from oil shale, they are not applicable to all types of oil shales. For example, Eastern shales are known to contain an equal proportion of organic carbon as the Western shales, however, upon conventional retorting, only about 30 percent of this carbon is converted to oil. This conversion is less than half of the conversion achieved by retorting Western shale. To clarify this fact, consider two oil shale samples, one Eastern and the other Western and each containing 13.6 percent organic carbon. Retorting the Western shale would reduce this carbon to about four percent. On the other hand, retorting the Eastern shale would reduce this carbon to about 10 percent. Thus, any technique that may be used to improve this conversion as measured by enhancement in oil yield will be highly advantageous particularly when applied to Eastern shale.

Accordingly, the present invention provides a process to enhance the yield of hydrocarbon fluids from oil shale by retorting the shale under critical processing conditions.

U.S. Pat. No. 4,238,315 to Patzer, II, relates to a process for recovering oil from oil shale containing kerogen which comprises bringing a mixture of oil shale and solvent to a temperature in the range of about 385° to about 400° C. in a time period of less than about 10 minutes, maintaining the mixture at a temperature in the range of about 385° to about 440° C. and a pressure in the range of about 250 to about 2,000 psig for a period of about 20 minutes to about 2 hours and thereafter recovering the resulting oil. Patzer states that a weight ratio of solvent to shale of at least 1.25:1, preferably at least 1.5:1 must be employed.

U.S. Pat. No. 4,325,803 to Green et al relates to a method for the separation and recovery of organic material from rock which includes forming a slurry comprising rock containing organic material and a hydrogen transfer agent that is liquid at standard conditions, subjecting the slurry to elevated temperatures (300° to 650° C.) and elevated pressure (10 atmospheres to 200 atmospheres), and subjecting the product to adiabatic flash vaporization. The Green et al process requires that the amount of hydrocarbon liquid added to the shale be at least 25 weight percent of the shale, and that the hydrocarbon liquid contain at least 25% hydrogen donating compounds. Furthermore, the Green et al process is limited to utilizing hydrogen transfer liquids which have a low boiling point not greater than 325° C. (617° F.).

Hampton in U.S. Pat. No. 1,778,515 states that it is old to subject a bituminiferous material, such as oil shale, to the digestive action of an oil bath to recover oil from oil shale. It is further stated that increased yields of oil can be obtained by mixing oil shale of $1\frac{1}{2}$ inch mesh with a heavy oil, which may be preheated, heating the resulting mixture gradually to a temperature of 300° to 400° F. (144° to 204° C.), grinding the shale in the heated mixture until 60 percent or more thereof will pass 200 mesh, and then heating the ground mixture, most desirable suddenly, to a materially high temperature in the range of about 600° to about 700° F. (316° to about 371° C.). Hampton considers the possibility of feeding dry pulverized shale, without any accompanying oil, in controllable amounts into a hot digestion bath, but advises against the same because of technical difficulties.

SUMMARY OF THE INVENTION

The present invention relates to a method for improving the recovery of hydrocarbonaceous fluids from oil shale containing organic carbons by applying critical modifications to conventional retorting conditions. In accordance with the present invention, oil shale is heated in a retort vessel to a temperature at which thermal decomposition of the organic carbons is initiated. The temperature normally observed at which thermal decomposition starts is about 375° C. After such a temperature is attained, a quantity of oil is introduced into the retort wherein the quantity of added oil is sufficient to enhance the conversion of organic carbon to hydrocarbonaceous fluids. Either during or after the addition of oil, heat is applied to the retort vessel to increase the temperature to that temperature where the highest amount of organic carbon conversion is obtained. Such a temperature has been observed to be from about 415° C. to about 425° C. depending on the oil shale treated. The highest conversion temperature is held for a period of time sufficient to allow substantial conversion of organic carbon material. Subsequently normal retorting is continued by increasing the temperature to about 525° or higher.

DESCRIPTION OF THE SPECIFIC EMBODIMENTS

While the present invention is described and claimed with relation to the treatment of oil shale, it should be understood that the present invention is applicable to the recovery of hydrocarbonaceous material from sedementary rock which contains appreciable quantities of organic materials wherein the recovery of the hydrocarbonaceous materials is achieved by retorting operations. For example, tar sands and other similar materials may be treated in accordance with the present invention to enhance the yield of hydrocarbonaceous fluids.

In accordance with the present invention the oil shale is crushed to a desired size and subsequently heated in a retort vessel to a temperature at which thermal decomposition of the organic carbons is initiated. The temperature normally observed at which thermal decomposition starts to take place is about 375° C. and may vary depending on the type of oil shale subjected to treatment. After the initial decomposition temperature is attained, a predetermined quantity of oil is added to the retort vessel while heating is continued to increase the temperature to that temperature where the highest amount of organic carbon conversion is obtained. The amount of oil added should be sufficient to enhance the conversion of organic carbons to hydrocarbonaceous fluids. It is preferred that the amount of oil added be at least 25% by weight of the organic carbons in the oil shale. Since retorting is carried under ambient pressures, the majority of the oil added should not distill at a temperature which is below the initial decomposition temperature or below the temperature for maximum organic carbon conversion. If the added oil has a lower boiling temperature, then the oil would vaporize and leave the retort vessel.

The maximum organic carbon conversion temperature has been observed to be from about 415° C. to about 425° C. and may vary depending on the type of oil shale treated. The maximum conversion temperature is maintained for a period of time sufficient to allow substantial conversion of organic carbon material. The time required will depend on the amount of organic carbons present in the oil shale. For example, when the oil shale contains from four to five weight percent organic carbons, the maximum conversion temperature should be maintained from about five to fifteen minutes or such time as all the kerogen is converted or decomposed.

After the substantial conversion of organic carbon material is obtained retorting is continued by increasing the temperature to retorting temperatures, for example 500° C. or 525° C.

Suitable materials to be utilized as added oils to the retort include petroleum aromatic extracts, heavy waxes which are obtained by de-waxing petroleum stock material, residual fractions of vacuum distillation, and bitumens obtained from tar sands. It is expected that all heavy oils which do not distill below 375° C. are suitable for utilization in the present invention.

To better illustrate the present invention, the following comparative examples were performed. In Example 1, a 100 gram sample of eastern shale was loaded in a conventional retort reactor and heated to about 415° C. The temperature of the retort was held for about 10 minutes after which conventional retorting procedure was resumed by heating to about 500° C. This example was carried out without the addition of yield enhancing oil. The results are shown in Table 1.

TABLE 1

| | |
|---|---|
| Oil Yield G/T | 13.2 |
| % wt | 5.1 |
| Spent shale, % wt | 90.2 |
| Gas yield, $H_2S$ free liters/100 g | 1.67 |
| $H_2S$ Yield, % by wt | 0.81 |
| Water, % wt | 1.9 |
| Oil Properties | |
| Gravity, °API | 22.6 |

TABLE 1-continued

| | |
|---|---|
| Sp. Gr. 60/60 °F. | 0.9182 |
| Elemental Analysis, % wt | |
| C | 85.27 |
| H | 10.87 |
| N | 1.13 |
| S | 1.62 |

In Example 2, a 100 gram sample of the same eastern shale used in Example 1 was loaded in a conventional retort reactor and heated to about 375° C. When the specified temperature of 375° C. was reached, 15 grams of oil, of which the major portion does not distill below 375° C., were introduced into the heated bed of shale after which heating continued such that the 15 grams of oil were introduced in the time it took the charge to reach about 415° C. The temperature of the charge was held at about 415° C. for about 10 minutes at the end of which retorting to about 500° C. was continued.

The oil added to the shale was obtained as follows: a petroleum vacuum distillation residue was extracted with propane. In lubricants manufacturing, the propane deasphalted oil has to be treated with a solvent to separate aromatics which are not desirable in lubricants from the aliphatics which are desirable. Accordingly, furfural was utilized to separate the aromatics from the propane extract. This furfural aromatic extract is the added oil utilized in Example 2. This extract begins to distill under reduced pressure at a temperature which when converted to ambient pressures becomes equivalent to about 1000° F. (538° C.)

In Example 3, a 15 gram sample of the same oil used in Example 2 was treated in the same manner as Example 2 except that the treatment was carried out in the absence of oil shale. The results of Examples 2 and 3 are shown in Table II.

TABLE II

| | EXAMPLE 2 | EXAMPLE 3 |
|---|---|---|
| Oil added G/T | 36.3 | 36.3 |
| Oil yield G/T | 54.1 | 33.5 |
| % wt | 21.0 | 90.0 |
| Spent shale, % wt | 90.0 | none added |
| Gas Yield, $H_2S$ free liters/100 g | 2.47 | 3.6 |
| $H_2S$ Yield, % by wt | 1.05 | trace |
| Water, % wt | 1.8 | NIL |
| Oil Properties | | |
| Gravity, °API | 21.0 | 20.8 (11.8) |
| Sp. Gr. 60/60 °F. | 0.9279 | 0.9291 (0.9874) |

*( ): fresh oil

Adding the FA yield of example 1 (13.2 G/T) with the amount of oil added to example 2 or 3 (36.3 G/T) would indicate that the present invention resulted in an excess yield of 4.6 gallons/ton (54.1−49.5=4.6) in the amount of oil recovered from the Eastern shale. Furthermore, an upgrading of the added oil itself resulted, i.e., an improvement in the °API gravity from 11.8 to 20.8. Example 3 shows that when the added oil, aromatic extract, is treated in accordance with the present invention but in the absence of oil shale, the oil was thermally decomposed and upgraded but with a loss of an equivalent 2.8 gallons/ton. When this is taken into account, the increase in oil yield from oil shale becomes 7.4 gallons/ton when the shale is treated in accordance with the present invention.

It is important to note that the process conditions of the present invention are critical. Since retorting is normally performed under atmospheric pressure in an open vessel, then the oil added to the shale should not boil off below the temperature where the organic carbon in the shale begins to decompose and preferably not below that temperature where maximum conversion of the organic carbon in the shale occurs. Furthermore, the addition of pressure to the retort vessel to keep the added oil from boiling off is detrimental to the process of the present invention.

The following experiments were conducted to illustrate the above conditions. In a typical experiment, about 120 grams of oil shale were mixed with about 15 grams of added oil and the mixure loaded into a reactor. The mixture was then heated to 410° C. and held at that temperature for 10 minutes. The experiment was then stopped and a 10 gram aliquot of the modified oil shale was extracted with a solvent while 100 grams were used for a Fischer Assay (ASTM D3904-80) determination. In some experiments, the reactor was pressurized as described in U.S. Pat. Nos. 4,238,315 and 4,325,803 such that a pressure of 400–650 psig was attained at 410° C. Hydrogenated clarified slurry oil (HCSO), hydrogenated nitrogen-concentrate (HNC) derived from a western shale oil, and an aromatic extract of a petroleum vacuum distillation residue were utilized as the added oils. The major portion of HCSO and HNC distilled at a temperature lower than 375° C. The results are listed in Tables III, IV, V, VI and VII.

TABLE III

YIELDS AND PROPERTIES OF PRODUCTS OBTAINED BY RETORTING A SAMPLE OF AN EASTERN SHALE

| | No Oil Added Fischer Assay | No shale HCSO | Shale +15% HCSO |
|---|---|---|---|
| Oil added G/T | — | 36.0 | 35 |
| Oil Yield G/T | 15.8 | 35 | 42.0 |
| % wt | 6.1 | 90 | 17.2 |
| Spent shale, % wt | 89.7 | — | 90.2 |
| Gas Yield, $H_2S$ free liters/100 g | 1.92 | — | 1.62 |
| $H_2S$ Yield, % by wt | 0.79 | 0 | 1.14 |
| Water, % wt | 2.0 | 0 | — |
| Oil Properties | | | |
| Gravity, °API | 22.5 | 1.4 | 12.6 |
| Sp Gr 60/60 °F. | 0.9188 | 1.0876 | 0.9818 |
| Elemental Analysis, % wt | | | |
| C | 85.52 | 89.61 | 89.03 |
| H | 10.79 | 9.60 | 9.76 |
| N | 1.13 | 0.3 | 0.60 |
| S | 1.60 | 0.9 | 1.54 |

TABLE IV

YIELDS AND PROPERTIES OF PRODUCTS OBTAINED BY RETORTING A SAMPLE OF AN EASTERN SHALE

| | No oil added Fischer Assay | No shale HNC | Shale +15% HNC |
|---|---|---|---|
| Oil added G/T | — | 36 | 34 |
| Oil Yield G/T | 17.7 | 34 | 32.3 |
| % wt | 6.8 | 90 | 19.7 |
| Spent shale, % wt | 88.5 | — | 89.9 |
| Gas Yield, $H_2S$ free liters/100 g | 1.98 | 1.9 | 2.63 |
| $H_2S$ Yield, % by wt | 1.01 | NIL | 1.13 |
| Water, % wt | 2.5 | NIL | 1.9 |
| Oil Properties | | | |
| Gravity, °API | 23.6 | 15.3 | 18.1 |
| Sp Gr 60/60 °F. | 0.9123 | 0.9639 | 0.9818 |
| Elemental Analysis, % wt | | | |
| C | 84.78. | — | 81.74 |
| H | 10.52 | — | 10.82 |
| N | 1.27 | 3.14 | 2.95 |

TABLE IV-continued

YIELDS AND PROPERTIES OF PRODUCTS OBTAINED BY RETORTING A SAMPLE OF AN EASTERN SHALE

| | No oil added Fischer Assay | No shale HNC | Shale +15% HNC |
|---|---|---|---|
| S | 1.59 | — | 0.96 |

TABLE V

YIELDS AND PROPERTIES OF PRODUCTS OBTAINED BY RETORTING A SAMPLE OF AN EASTERN SHALE

| | No oil added Fischer Assay | No shale Extract | Shale +15% Extract |
|---|---|---|---|
| Oil added G/T | — | 36.3 | 33.5 |
| Oil Yield G/T | 13.2 | 33.5 | 54.0 |
| % wt | 5.5 | 90 | 21.0 |
| Spent shale, % wt | 90.2 | — | 90.0 |
| Gas Yield, $H_2S$ free liters/100 g | 1.67 | 3.6 | 2.47 |
| $H_2S$ Yield, % by wt | 0.81 | trace | 1.05 |
| Water, % wt | 1.9 | NIL | 1.8 |
| Oil Properties | | | |
| Gravity, °API | 22.6 | 20.8 | 21.0 |
| Sp Gr 60/60 °F. | 0.9182 | 0.9291 | 0.9279 |

TABLE VI

YIELDS AND PROPERTIES OF PRODUCTS OBTAINED BY RETORTING A SAMPLE OF AN EASTERN SHALE

| | No oil added Fischer Assay | Shale +15% HCSO |
|---|---|---|
| Oil added G/T | — | 35.9 |
| Oil Yield G/T | 13.2 | 44.3 |
| % wt | 5.5 | 17.7 |
| Spent shale, % wt | 90.2 | 89.1 |
| Gas Yield, $H_2S$ free liters/100 g | 1.67 | 3.21 |
| $H_2S$ Yield, % by wt | 0.81 | 0.99 |
| Water, % wt | 1.9 | 1.4 |
| Oil Properties | | |
| Gravity, °API | 22.6 | 16.3 |
| Sp Gr 60/60 °F. | 0.9182 | 0.9574 |
| Elemental Analysis, % wt | | |
| C | 85.26 | 82.46 |
| H | 10.87 | 10.53 |
| N | 1.13 | 2.96 |
| S | 1.62 | 0.65 |

TABLE VII

YIELDS AND PROPERTIES OF PRODUCTS OBTAINED BY RETORTING A SAMPLE OF AN EASTERN SHALE

| | No oil added Atmospheric | Extract | Shale +15% Extract @ 650 psig |
|---|---|---|---|
| Oil added G/T | — | 36 | — |
| Oil Yield G/T | 13.2 | — | 31.8 |
| % wt | 5.5 | — | 12.3 |
| Spent shale, % wt | 90.2 | — | 93.1 |
| Gas Yield, $H_2S$ free liters/100 g | 1.67 | — | 4.66 |
| $H_2S$ Yield, % by wt | 0.81 | — | 1.28 |
| Water, % wt | 1.9 | — | 1.0 |
| Oil Properties | | | |
| Gravity, °API | 22.6 | 11.8 | 45.5 |
| Sp Gr 60/60 °F. | 0.9182 | 0.9881 | 0.7996 |
| Elemental Analysis, % wt | | | |
| C | 85.26 | — | 85.32 |
| H | 10.87 | — | 12.28 |
| N | 1.13 | — | 0.31 |
| S | 1.62 | — | 1.73 |

Samples of Indiana and Kentucky (Eastern) shales were treated. In the cases where HCSO and HNC were used, no yield enhancement over Fischer Assay (FA) was observed (Tables III and IV). From these observations, it was concluded that at atmospheric pressure the added oil was volatile at FA retorting conditions and did not contact the shale at the appropriate temperature to generate the incremental oil. The appropriate temperature is considered to be that where organic carbon conversion takes place. In experiments in which HCSO and HNC were retorted in accordance with the present invention but without the shale, it was observed that over 90% of the added oil "distilled" out of the retort by the time the retort temperature reached 400° C. For the higher boiling luricating oil aromatic extract however (Table V), yield benefit was derived. It was observed for the blank experiment (without shale) that product appeared in the recovery system only after the temperature of the retort had reached about 470° C. From the quantities of oil recovered it may be concluded that an incremental 6.9 G/T of oil were produced. This represents 152% of FA.

When HCSO is used the gravity of the collected oil is 12.6°API. This is 10°API lower than the oil produced when the FA is carried out on the shale without the added oil.

In the experiment of Table VI, the objective was to "treat" an oil shale with the added oil under the conditions that favor the formation of soluble matter from the kerogen. The treated shale was then to be retored in the usual FA manner, with the hope of generating distillable oil without the use of a solvent extraction step. A net loss of about 4.8 G/T is observed. This is calculated by adding the FA yield of the shale to the amount of added oil in G/T, i.e., 13.2 G/T FA yield added to 35.9 G/T added oil totals to 49.1 G/T. This total is compared to 44.3 G/T, which is the yield of oil produced as a result of retorting the treated shale, to show that a net loss of 4.8 G/T is obtained.

Table VII shows the effect of added pressure on the process of the present invention. Since the added oil chosen was a high boiling aromatic extract, the reactor was loaded and pressurized to about 250 psig with argon before heating was started.

When the temperature of the bed of shale in the reactor reached 410° C. this temperature was held for about 10 minutes. Heating was then continued until the shale temperature reached 500° C., the usual maximum temperature of the FA. Again no yield enhancement over FA was observed under these experimental conditions.

Although the present invention has been described with preferred embodiments, it is to be understood that modifications and variations may be resorted to, without departing from the spirit and scope of this invention, as those skilled in the art will readily understand. Such modifications and variations are considered to be within the perview and scope of the appended claims.

What is claimed is:

1. A method for recovering hydrocarbonaceous fluids from oil shale containing organic carbon material, which comprises:

(a) heating the oil shale in a retort vessel at ambient pressure to a temperature at which thermal decomposition of the organic carbons contained in said oil shale is initiated;

(b) introducing into the retort a sufficient quantity of oil, for enhancement of carbon conversion, which oil does not substantially distill at a temperature below said initial decomposition temperature or below the temperature for maximum organic carbon conversion of said oil shale, while heat is applied to the retort vessel to increase the temperature to about 410°–425° C. wherein the highest amount of organic carbon conversion to hydrocarbonaceous liquids is obtained;

(c) holding the temperature for a period of time sufficient to allow substantial conversion of organic carbon material; and (d) increasing the temperature to retorting temperatures and recovering the resultant hydrocarbonaceous fluids including oil introduced in step (b).

2. The method of claim 1 wherein the organic carbon material is selected from the group consisting of kerogens or bitumens.

3. The method of claim 1 wherein the initial decomposition temperature is about 375° C.

4. The method of claim 1 wherein the quantity of oil added is at least about 20% of the organic carbons present in the oil shale.

5. The method of claim 1 wherein the quantity of oil added is at least about 100% of the organic carbons present in the oil shale.

6. The method of claim 1 wherein the majority of the oil added does not distill below about 375° C.

7. The method of claim 1 wherein the added oil is selected from the group consisting of petroleum distillates, waxes, petroleum aromatic extracts, residual fractions of vacuum distillation, bitumens obtained from solvent extraction of tar sands or any combination thereof.

8. The method of claim 1 wherein the highest conversion temperature is from about 415° C. to about 425° C.

9. The method of claim 1 wherein the highest conversion temperature is maintained for from about five to about twenty minutes.

10. The method of claim 1 wherein the temperature in step (d) is increased to about 525° C.

11. A method for recovering hydrocarbonaceous fluids from oil shale containing organic carbon material, which comprises:

(a) mixing the shale with a quantity of oil, which does not substantially distill below the temperature at which thermal decomposition of the organic carbons is initiated or below the temperature for maximum oganic carbon conversion of said oil shale;

(b) heating the mixture in a retort vessel at ambient pressure and to a temperature of about 410°–425° C. at which the highest amount of organic carbon conversion to hydrocarbonaceous liquids is obtained;

(c) holding the temperature for a period of time sufficient to allow substantial conversion of organic carbon material;

(d) increasing the temperature to retorting temperatures; and (e) recovering the resulting hydrocarbonaceous fluids including the quantity of oil in step (a) wherein the quantity of oil added in step (a) is sufficient to cause an increase in the amount of hydrocarbonaceous fluids recovered from the oil shale via said organic carbon conversion.

12. The method of claim 11 wherein the organic carbon material is selected from the group consisting of kerogens or bitumens.

13. The method of claim 11 wherein the initial decomposition temperature is about 375° C.

14. The method of claim 11 wherein the quantity of oil added is at least about 20% of the organic carbons present in the oil shale.

15. The method of claim 11 wherein the quantity of oil added is at least about 100% of the organic carbons present in the oil shale.

16. The method of claim 11 wherein the majority of the oil added does not substantially distill below about 375° C.

17. The method of claim 11 wherein the added oil is selected from the group consisting of petroleum distillates, waxes, petroleum aromatic extracts, residual fractions of vacuum distillation, bitumens obtained from solvent extraction of tar sands or any combination thereof.

18. The method of claim 11 wherein the highest conversion temperature is from about 415° C. to about 425° C.

19. The method of claim 11 wherein the highest conversion temperature is maintained for from about five to about twenty minutes.

20. The method of claim 11 wherein the temperature in step (d) is increased to about 525° C.

21. A method for maximizing the recovery of hydrocarbonaceous fluids from oil shale containing organic carbon material where said oil shale is converted with an oil in a retort comprising:

(a) heating said oil shale in said retort at ambient pressure to about 375° C. which temperature is sufficient to cause initial thermal decomposition of the organic carbons contained in said oil shale;

(b) introducing into said retort a sufficient quantity of oil for enhancement of organic carbon conversion, where said oil does not substantially distill below 375° C. or below about 410° C. to about 425° C., the latter being the temperature for maximum organic carbon conversion to hydrocarbonaceous liquids of said oil shale;

(c) heating said oil shale and said oil within said retort to a temperature of about 410° C. to about 425° C., which temperature is sufficient to obtain said maximum organic carbon conversion;

(d) holding the temperature between about 410° C. to about 425° C. for about 5 to about 25 minutes which time period is sufficient to allow substantial conversion of said organic carbon;

(e) increasing subsequently the temperature to about 525° C. or higher and continuing the retorting process; and (f) recovering an increased yield of shale oil including the oil introduced in step (b).

* * * * *